United States Patent [19]

Jeschke et al.

[11] Patent Number: 4,947,746

[45] Date of Patent: Aug. 14, 1990

[54] PRINT CONTROL STRIP

[75] Inventors: Willi Jeschke, Heidelberg; Gerhard Löffler, Walldorf, both of Fed. Rep. of Germany

[73] Assignee: Heidelberger Druckmaschinen Aktiengesellschaft, Heidelberg, Fed. Rep. of Germany

[21] Appl. No.: 450,407

[22] Filed: Dec. 14, 1989

Related U.S. Application Data

[63] Continuation of Ser. No. 136,030, Dec. 21, 1987.

[30] Foreign Application Priority Data

Dec. 20, 1986 [DE] Fed. Rep. of Germany ..... 3643721

[51] Int. Cl.[5] ..... B41F 5/16; B41F 31/04

[52] U.S. Cl. ..... 101/211; 101/181; 101/365; 101/DIG. 46

[58] Field of Search ..... 101/365, 350, 211, 181, 101/352, 148, 363, 364, 207–210, DIG. 45, DIG. 46, DIG. 47, 483, 211; 364/526; 356/402, 406, 407, 408

[56] References Cited

U.S. PATENT DOCUMENTS

| | | | |
|---|---|---|---|
| 3,393,618 | 7/1968 | Baker | 95/1 |
| 4,200,932 | 4/1980 | Schramm et al. | 364/519 |
| 4,469,025 | 9/1984 | Löffler et al. | 101/171 |
| 4,505,589 | 3/1985 | Ott et al. | 356/402 |
| 4,606,633 | 8/1986 | Jeschke et al. | 356/237 |
| 4,852,485 | 8/1989 | Brunner | 101/211 |

FOREIGN PATENT DOCUMENTS 3604222 9/1986 Fed. Rep. of Germany .

OTHER PUBLICATIONS

"A Color Proofing Update", American Printer, M. Bruno, Jul. 1985.

"GATF Compact Color Test Strip", Research Progress, Z. Elyjiw, 79, 8/1968.

*Primary Examiner*—J. Reed Fisher

*Attorney, Agent, or Firm*—Nils H. Ljungman

[57] ABSTRACT

A print control strip which allows the optional use of both solid tone control/regulation and halftone control/regulation, and in which the color control/regulation is optimized on the basis of values derived from the solid tone density and the halftone density from single color and/or multicolor halftone fields. Such print control strips are used for control/regulation of the ink feed in the inking mechanism of rotary printing presses. The print control strip disclosed includes alternating single color solid tone fields for each ink color and single color halftone fields for each ink color, and multicolor halftone fields corresponding to every second color zone. There may also be zonally alternating single color solid tone fields for each ink color and multicolor halftone fields.

15 Claims, 11 Drawing Sheets

B=BLACK
C=CYAN
M=MAGENTA
Y=YELLOW

14

14

PRINT CONTROL STRIP

This is a continuation of application Ser. No. 07/136,030, filed on Dec. 21, 1987.

BACKGROUND OF THE INVENTION

1. Field of the Invention:

The present invention relates to a print control strip for control and regulation of the printing process with individual color fields of different colors and structure arranged in a row, which are divided in accordance with the color zones of the ink duct of a printing press.

OBJECT OF THE INVENTION

One object of the present invention is the creation of a print control strip, which makes possible the optional use of both solid tone control/regulation and halftone control/regulation. In addition, color control/regulation can be optimized on the basis of values derived from the solid tone density (DV) and the halftone density (DR) of single color and/or multicolor screen fields.

SUMMARY OF THE INVENTION

The present invention features a print control strip which exhibits zonally alternating single color solid tone fields for each ink color and single color halftone fields for each ink color. The essential advantage of a print control strip constructed in this manner is that the printer has the option of using one or the other control or regulation strategy, depending on the task at hand. For example, he can perform the adjustment and tuning according to standard solid tone densities, and set the production run to constant halftone densities or halftone values of an adjustment sheet. And the reverse can be done if, for example, there is a "substitute proof" such as "Cromalin" or "Matchprint" available as a master. In such a case it is better to take over the halftone densities or the tonal value of the printed area from the control strip of the master as the setpoints, and to adjust to these, and to switch to solid tone density regulation in the production run. Using the solid tone density of the "substitute proof" would lead to a completely false color impression.

Another advantage offered by the two zone structure of the print control strip for solid tone and halftone regulation is that, compared to the single zone structure, only half as many measurements need to be taken and processed.

The printer is, therefore, not forced to purchase, store and manage several types of print control strips, which results in lower costs. Nor must he decide before the printing plate copy which regulation method he will use in the printing.

Changes in the halftone density of halftone dot size cause significantly greater color shifts in the image than changes in the solid tone density. On account of the identical frequency of solid tone and halftone fields, halftone values can be determined in very large number from immediately adjacent fields, which leads to a more secure monitoring and control/regulation than if the solid tone density (DV) or the halftone density (DR) can be determined only sporadically.

Additionally, the invention offers the further advantage that the additional multicolor halftone fields in the print control strip are optimally suited both for densitometric and colorimetric measurement. The multicolor measurement fields are integrated into the print control strips with the same frequency as the single color solid tone and halftone fields, i.e., also two zone.

There is also described an embodiment with single color solid tone fields and multicolor halftone fields in the two zone structure.

Furthermore, the control strips can also be used optionally for control/regulation on the basis of densitometric values or values from colorimetric measurements. For this purpose, specifically for the colorimetric measurements, it contains multicolor halftone fields in each second zone. It is therefore also possible to make adjustments colorimetrically, e.g., on the basis of multicolor halftone fields, and to optimally regulate the production run on the basis of solid tone or halftone densities, according to halftone values or according to the relative print contrast K, which is determined according to the formula $K = (DV-DR) : DV$. (DV=solid tone density, DR=halftone density).

It is believed that the measurement methods used in printing technology are more precise the higher the surface coverage at the measurement point. Solid tones, i.e., surfaces 100 percent covered, are measured with the greatest precision. That has been shown to be true both in theory and in practice. It makes sense because the higher the proportion of surface coverage with color information, the greater the absolute measurement value, and the smaller the relative measurement error, since the absolute measurement error is practically constant.

For the halftone measurement, it is appropriate from this point of view to select a coverage percentage region in the vicinity of the three quarter tone, since here, the proportion of surface coverage is relatively high. In the densitometric halftone measurement, which on account of the measurement method can be conducted with sufficient precision only in single color halftone fields, the average and three quarter tone is, therefore, generally monitored. In the prior art, multicolor halftone fields have been inspected only visually. In accordance with one aspect of the invention, there are multicolor dot halftone fields, which are optimally suited for the purpose, particularly for colorimetric measurement.

In accordance with another aspect of the invention, a surface coverage composition of the individual colors in question is proposed for the measurement of multicolor dot halftone, which as the sum of all the single color, two color and, if any, three and four color partial surfaces, give approximately the same degree of surface coverage as the single color halftone fields used in the control strip.

In general, the invention features a print control strip image production apparatus for producing an image on a printing plate indicative of the printing conditions of a printing press. The printing press is provided with at least a first plurality of ink metering ducts for metering the application of a first ink in the printing press, each of the ink metering ducts substantially defining an ink zone of the printing press. The print control strip image production apparatus comprises an image bearing medium having thereon a plurality of measurement field images: a first of the plurality of measurement field images comprising an image of a solid tone field; and a second of the plurality of measurement field images comprising an image of a halftone field. The first and second measurement fields are alternately disposed on said image bearing medium.

In another aspect, the invention features a process for controlling the application of at least one ink in a printing press provided with at least one printing plate. The printing press is provided with at least a first plurality of ink metering ducts for metering the application of the at least one ink in the printing press, each of the ink metering ducts substantially defining an ink zone. The process comprises the steps of:

(a) producing, on the printing plate, an image of a print control strip, the print control strip image comprising a plurality of measurement field images, a first of the plurality of measurement field images comprising an image of a solid tone field, and a second of the plurality of measurement field images comprising an image of a halftone field, the first and second measurement fields being alternately disposed on the image bearing medium:

(b) applying the at least one ink through the first plurality of ink metering ducts to the printing plate; (c) transferring the at least one ink from the printing plate to a print receptor to form an image of the print control strip thereon; (d) analyzing the image of the print control strip on the print receptor: and (e) adjusting the ink metering ducts based upon the analysis step (d).

Embodiments of the invention are schematically illustrated in the drawings.

Figure 3A:
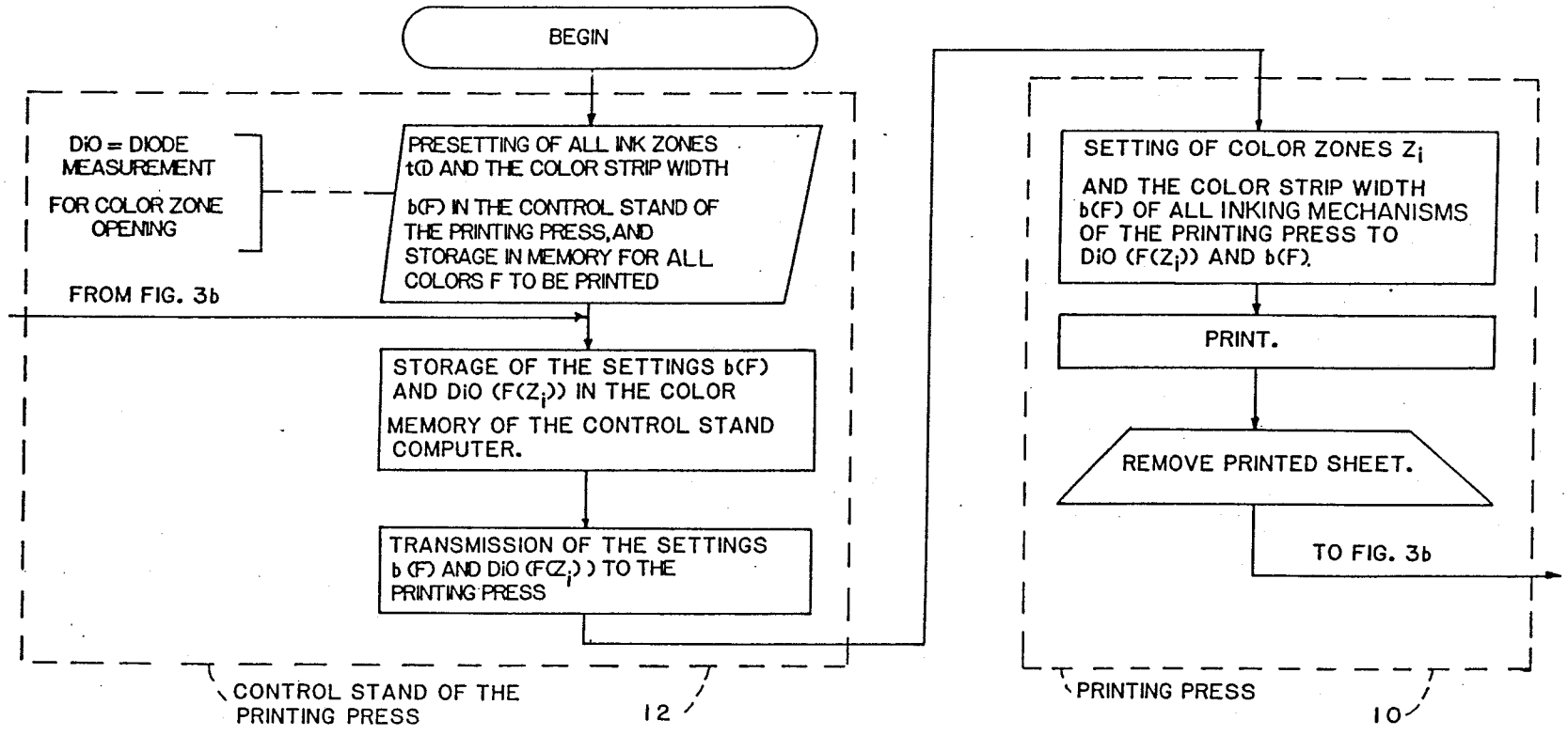
Figure 3B:
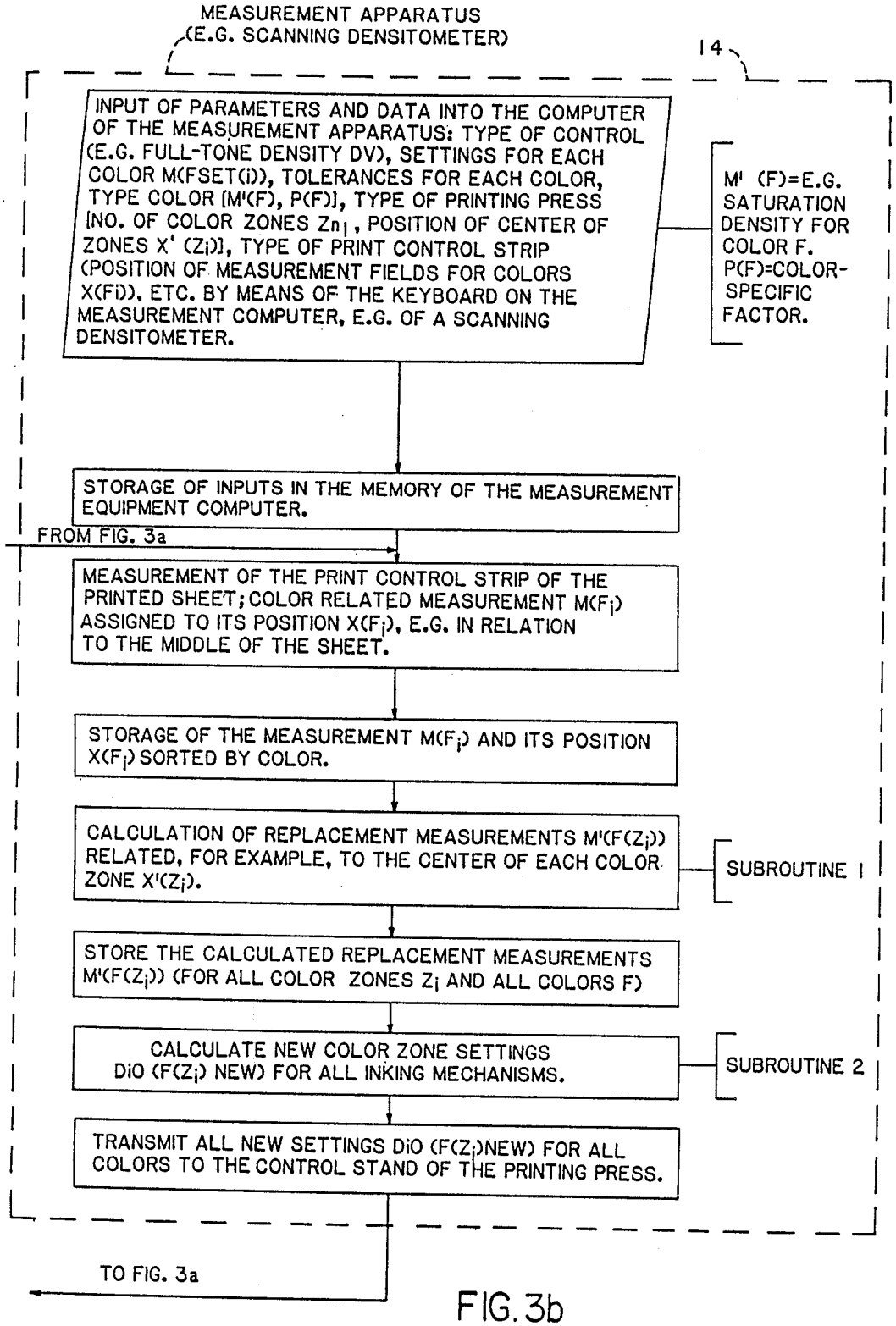
Figure 4:
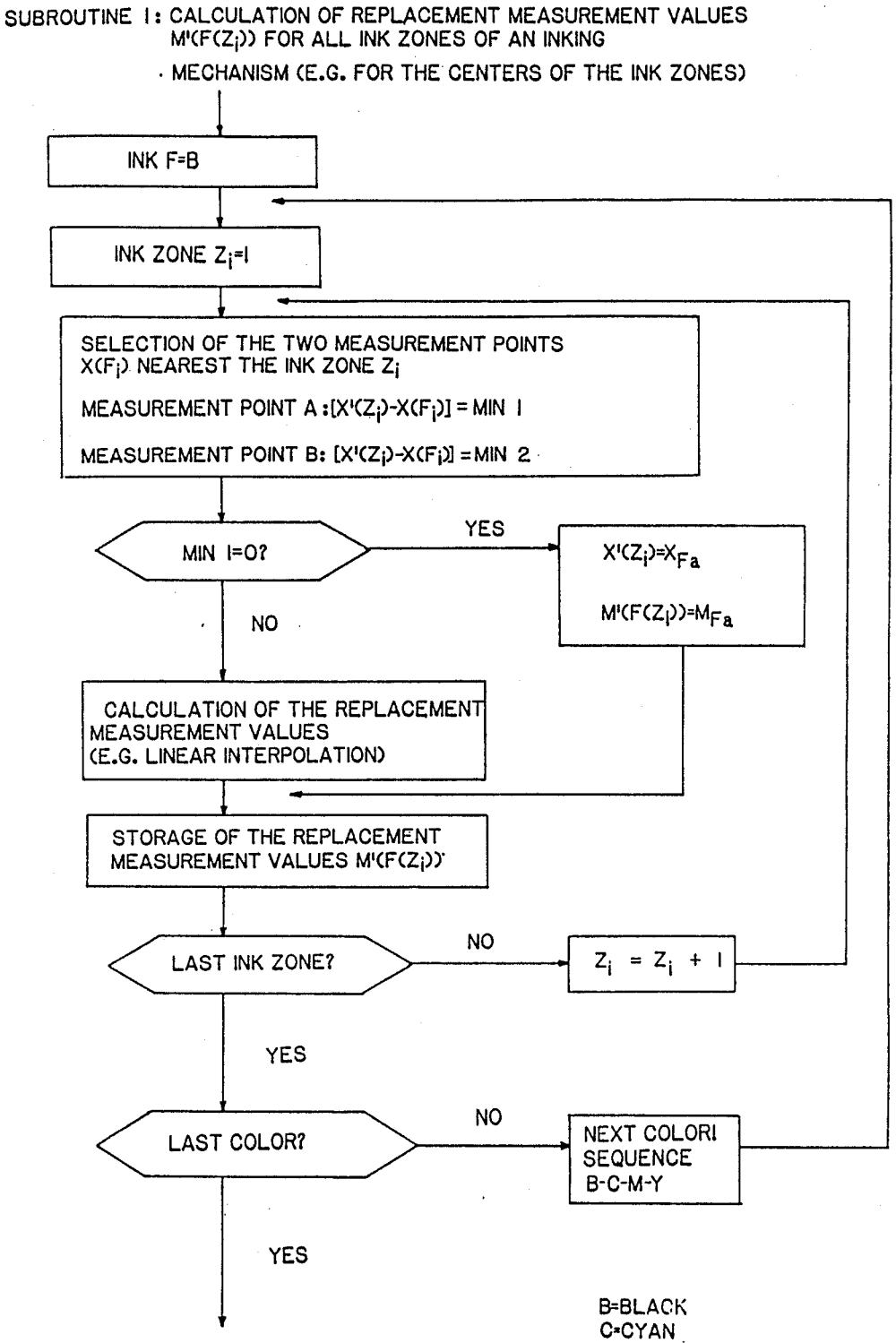
Figure 6:
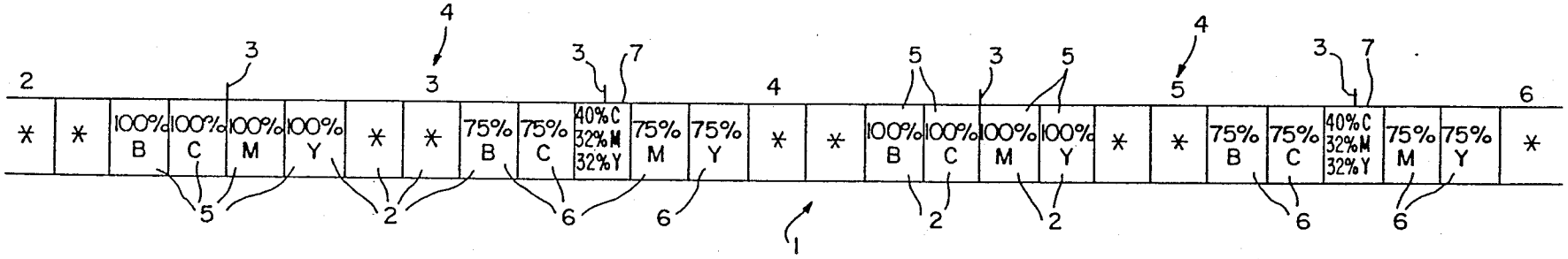

FIGS. *3a* and *3b* are a flow chart of an algorithm for implementing a measurement and adjustment process according to the invention;

FIG. 4 is a flow chart of a subroutine in the algorithm of FIG. 3;

FIGS. *5a* and *5b* are a flow chart of another subroutine in the algorithm of FIG. 3:

FIG. 6 is a schematic representation of an alternate embodiment of a print control strip: and FIGS. *7a*, *7b*, *7c* and *7d* are a flow chart of an algorithm for adjusting and controlling a printing process utilizing the print control strip of FIG. 6.

DESCRIPTION OF THE PREFERRED EMBODIMENTS

Print control strips are a known means for the evaluation and control of print quality in the stage prior to printing on modern printing presses. For this purpose, such print control strips have fields, which are present in varying numbers and configurations for each color to be printed (e.g., so called signal fields and measurement fields) which are evaluated on a purely visual basis. In addition, multicolor fields are also generally required for certain control operations. As a rule, a print control strip contains the following fields:

Solid Tones one color: for measurement of the ink thickness;

two color: for measurement of the color absorption; and three color: for measurement of the color absorption and a visual evaluation of the color balance.

Halftones one color: for measurement of the tone value increase; and three color: for visual evaluation of the color balance.

Line Screen one color: for visual evaluation or measurement of slip and doubling.

There can also be fields with microlines and microdots for certain purposes.

Densitometers are used almost exclusively in the prior art to measure the individual fields of the print control strip, and other color measurement devices only in special cases.

The divisions of such print control strips used for the control and/or regulation of ink delivery are adjusted to the color zone intervals of the printing press in question. In each color zone, there are single color solid tone measurement fields for zonal control/regulation according to the "Solid Tone Density DV" measurement value. The control and/or measurement fields for the evaluation of other quality criteria occur with less frequency on the print control strips.

Print control strips are well known in the art and are discussed in U.S. Pat. Nos. 3,393,618 entitled "Printing Control" and 4,469,025 entitled "Device for Mounting Print Control Strips at a Precise Level and in Registry" and in the documents "GATF Compact Color Test Strip", Zenlon Elyjin, GATF Research Progress, No. 79 (August, 1968), "A color Proofing Update", Michael H. Bruno, American Printer (July, 1985) and "Testing, Measuring, Printing - Earning Money", Heidelberg News, Issue 4 (1976) published by Heidelberger Druckmaschinen AG, D-6900 Heidelberg, Federal Republic of Germany, all of theses patents and publications being hereby expressly incorporated by reference as if the contents thereof were set forth in their entirety herein.

The print control strip 1 reproduced in FIG. 1 exhibits measurement fields 2, which are present in the illustrated embodiment in the following colors:

(B) black
(C) cyan
(D) magenta
(Y) yellow

The ink cartridge of the corresponding printing press is divided into ink zones 3. The boundaries 4 between ink zones are indicated. A shown in FIG. 1, the lateral arrangement and frequency of the measurement fields 2 do not coincide with the ink zones 3.

Figure 1:
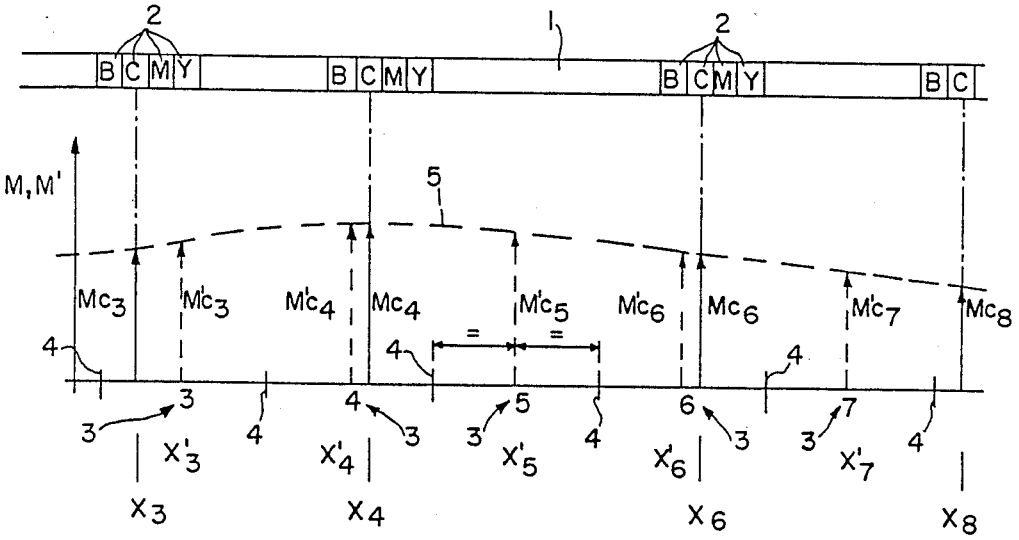
FIG. 1 shows schematically an interpolation curve according to the process.

In the embodiment illustrated in FIG. 1, the measurement values for Color C (cyan) are plotted. The measurements themselves are shown on the ordinate with the designation M, M'. The values actually measured are shown as vectors $Mc_3$, $Mc_4$, $Mc_6$ and $Mc_8$, and are stored in a measurement apparatus. The lateral positions of these measurement values $X_3$, $X_4$, $X_6$ and $X_8$ are recorded and also stored. From the measurement values and their lateral position, a computer determines an interpolation curve 5, from which the derived substitute measurement values $M'c_3$, $M'c_4$, $M'c_5$, $M'c_6$, $M'c_7$ . . . are determined for the center of each ink zone $X'_3$, $X'_4$, $X'_5$, $X'_6$, $X'_7$ . . . . Then the controlled variables for each zone are computed in the same manner as previously from "genuine" measurement values.

In other words, and still referring to FIG. 1, it will be seen that the ink zones 3 extend between boundaries 4 which separate the ink zones. From a study of FIG. 1, it will also be appreciated that the measurement fields 2, for the particular print control strip 1 shown, do not align with the center points $X'_3$, $X'_4$, $X'_5$, $X'_6$, $X'_7$ . . . of the ink zones of the particular printing press being employed. Therefore, when the color measurement fields 2 on the print control strip 1 are analyzed (as, for example, when using a densitometer)., the actual measured color related values $Mc_3$, $Mc_4$, $Mc_6$ and $Mc_8$ will be recorded. These actual measured color related values, however, will be related not to the center of the ink zones of the printing press being used, but rather, will be related to a series of distance measurements $X_3$, $X_4$, $X_6$ and $X_8$ which correspond to the lateral position of the actual measured color related values along the line of the consecutive ink zones.

However, in the embodiments of the present invention, it has been found that by using the actual measured color related values and by fitting a curve thereto, the thus derived empirical curve may be used to derive a series of substitute color related measurement values $M'c_3$, $M'c_4$, $M'c_5$, $M'c_6$, $M'c_7$ . . . which correspond to a close approximation of the color related measurement values at the center of each ink zone.

Figure 2:
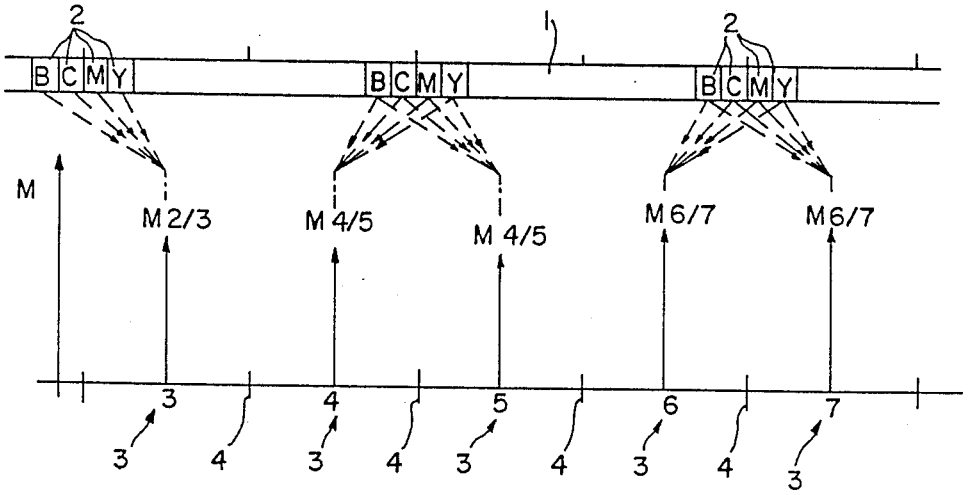
FIG. 2 shows the determination of the measurement values according to an embodiment of the invention used when the measurement fields are located near the boundaries between the ink zones.

FIG. 2 shows a printing control strip 1 with the measurement fields described above, and the ink zones 3 are listed on the abscissa located underneath. The measurements M are plotted on the ordinate, whereby the values are listed as M $\frac{2}{3}$, M 4/5, M 6/7, which means that they were determined from the ink zones 2 and 3, 4 and 5, 6 and 7. The measurement values from the boundary area of two neighboring zones are always transferred to the ink zone center of the two neighboring zones. This simple process can be applied wherever measurement strips are used whose control/regulation fields 2 are located near the ink zone boundary 4 and correspond to the ink zone division of the machine in question.

Thus, and still referring to FIG. 2, in the situation where the measurement fields 2 of the particular print control strip 1 being used happen to be located at or near the boundaries 4 separating the ink zones 3 of the particular printing press being employed, the actual measured color related values are used for each ink zone flanking the ink zone border 4 at or near to where the measurement field 2 is located.

As a result of the proposed process, control and regulation on the basis of single zone control measurement field arrangements is also improved. This process can also be used when measurements are taken not from printing control strips, but "in the image".

FIG. 3 (i.e., FIGS. 3*a* and 3*b* viewed in conjunction with one another) depicts a flow chart relating to an algorithm used to implement the present inventive process. In FIG. 3, for purposes of illustration, the various algorithmic steps have been shown as being divided up among a printing press 10, a control stand 12 for controlling the operation of printing press 10 and a measurement apparatus 14 (for example, a scanning densitometer) having an associated input device (such as a keyboard), programmable memory and software. However, whereas the algorithm depicted in FIG. 3 (as well as associated FIGS. 4, 5*a* and 5*b*) constitutes the best mode implementation known to the inventors at the present time, other algorithms for implementing the present invention may nonetheless be equivalent to that specifically set forth and will, therefore, fall within the spirit and scope of the present invention as defined in the appended claims.

Some examples of algorithms are to be found in U.S. Pat. Nos. 4,660,470 entitled "Inking Unit Pre-adjustment Method" and 4,200,932 issued Apr. 29, 1980 to Schramm, et al., which are incorporated by reference as if the contents thereof were set forth herein in their entirety.

FIG. 3 assumes that there is to be some "presetting" of the printing press variables. For example, and referring most particularly to FIG. 3*a*, initially, the following variables may be entered into the control stand 12:

- the ink zones t(i) [or $Z_i$](i=1, 2 . . . n) for n ink zones;
- the color strip width b(F) for each color F (e.g., black, cyan, magenta and yellow, etc.) to be printed; and
- the ink metering duct settings or signals Dio(F($Z_i$)) for each ink zone $Z_i$ and each color F.

These preset values are stored in the memory of the control stand 12 and are, at an appropriate time, also transmitted to the printing press 10. Such preset values may be available due to earlier printings of the same material. They may also be derived from the output of a printing plate image reader such as the one described in the publication entitled "Heidelberg CPC", published by Heidelberger Druckmaschinen AG, D-6900 Heidelberg (Publication No. HN 2/43.e), or the one disclosed in U.S. Pat. No. 4,681,455 entitled "Method of Determining the Area of Coverage of a Printed Original or a Printing Plate for Printing Presses", equivalent to published European Patent Appln. No. 0 095 606 AZ, all of these documents being hereby expressly incorporated by reference as if set forth in their entirety herein.

In the documents incorporated immediately above, a particularly advantageous arrangement is described wherein the presetting data for a particular printing plate may be recorded on a data processing magnetic tape cassette (such as those manufactured by Hewlett Packard Company, 3000 Hanover Street, Palo Alto, Calif. 94304) which may then be used to input this data into control stand 12.

Referring now most particularly to FIG. 3*b*, various relevant parameters are also entered into measurement apparatus 14 via the associated input device and are stored in the programmable memory provided therewith. For example, the following parameters may be entered:

- the type of control to be employed, for example, solid tone density DV or halftone density DR;
- the desired color related values for each color M(Fset(i));
- the allowed tolerance F for each color;
- the saturation density M'(F) and the color specific factor P(F) for each color F;
- specific variables relating to the particular printing press 10 being used, for example, the number of ink zones $Zn_1$ and the position of the center points of the ink zones X'($Z_i$); and
- specific variables relating to the type of print control strip being used, for example, the position of the color measurement fields X($F_i$).

A number of preproduction sheets are now printed sufficient to allow some stabilization of the printing process, whereupon a printed sheet is removed from the printing press 10 and transferred to the measurement apparatus 14. There, the print control strip produced on the printed sheet (such as is schematically shown in FIG. 1) is analyzed by the measurement apparatus 14 which produces a series of paired values M($F_i$), X($F_i$), the actual color related measured value and its actual position for each appearance of each color on the print control strip. The positions $X(F_i)$ may conveniently, if desired, be related to the middle of the printed sheet. These paired actual color related measured values and positions are then sorted by color F so as to yield a series of measured data points across the width of the printed sheet.

By use of an interpolation routine, the substitute color related measured values $M'(F(Z_i))$ are now calculated for the center of each ink zone $X'(Z_i)$ To this end, a linear interpolation subroutine, indicated as Subroutine 1, which may be employed, is more particularly illustrated in FIG. 4. However, it is to be understood that the present invention is not limited to the use of linear interpolation, but rather, it is contemplated that other well known, nonlinear interpolation techniques could also be employed without departing from either the spirit or the scope of the present invention. Interpolation techniques are taught in U.S. Pat. Nos. 4,670,892 entitled "Method and Apparatus for Computed Tomography of Portions of a Body Plane", 4,449,196 entitled "Data Processing System for Multi-Precision Arithmetic" and 4,682,894 entitled "Calibration of Three-Dimensional Space", all of which are incorporated by reference as if the contents thereof were fully set forth herein.

Referring now to FIG. 4, it will be seen that the substitute color related measured values $M'(F(Z_i))$ are calculated, through the use of well known incrementation techniques, for each ink zone $Z_i$ and for each ink color F=B, C, M, Y, etc. For each ink zone center of each color, two measurement points, measurement point a and measurement point b are selected. Measurement point a relates to the absolute value $[X'(Z_i)-X(F_i)]=\min 1$, and measurement point b relates to the absolute value $[X'(Z_i)-X(F_i)]=\min 2$. The values min 1 and min 2 represent the distances from the center point of the ink zone $X'(Z_i)$ to the nearest actual measured color related value on opposing sides of the corresponding ink zone center. The value min 1 is then tested as to whether or not it has a value of zero. If so, indicating that the ink zone center coincides with measurement point a, interpolation becomes unnecessary for this particular data point, and the actual measured position and color related value are stored as the substitute measured values for this particular data point.

If the testing on min 1 yields a non-zero value, then subroutine 1 performs a linear interpolation between measurement points a and b (the two nearest actual measured values flanking, on opposite sides, the center of the ink zone) to derive a substitute measured value $M'(F(Z_i))$ for the center point $X'(Z_i)$ of the ink zone.

The following example illustrates the calculation of the substitute measurement value $M'_{C5}$ according to subroutine 1 of FIG. 4 and in accordance with the particular parameters shown in FIG. 1. Here the color F is chosen to be cyan C. Moreover, whereas the following example utilizes linear interpolation, as noted above, the use of other well known nonlinear interpolation techniques are contemplated as being within the scope of the present invention.

EXAMPLE:

Measured are:

| Measured are: | |
|---|---|
| $M_{C3}$ = 1.35 D | $X_3$ = 63.5 mm |

-continued

| Measured are: | |
|---|---|
| $M_{C4}$ = 1.60 D | $X_4$ = 103 mm |
| $M_{C6}$ = 1.35 D | $X_6$ = 160 mm |
| $M_{C8}$ = 1.05 D | $X_8$ = 203.5 mm |

Color zone centers given as:
$X'_3=71$ mm
$X'_4=99.5$ mm
$X'_5=128$ mm
$X'_6=156.5$ mm
$X'_7=185$ mm
Color F=C (Cyan)
Color zone i=5
Nearest measurement points $X_{Ci}$:
Meas. Pt. a : absolute value $[X'_5-X_4]=25$ mm=min 1
Meas. Pt. b : absolute value $[X'_5-X_6]=32$ mm=min 2 min $1=0_{\rightarrow no}$ $$M_{Fa} = M_{C4};\ X_{Fa} = X_4$$
$$M_{Fb} = M_{C6};\ X_{Fb} = X_6$$
$$X'(Z_i) = X'_5$$

$$M'(F(Z_i)) = M_{Fa} + (M_{Fb} - M_{Fa}) \cdot \frac{X'(Z_i) - X_{Fa}}{X_{Fb} - X_{Fa}}$$

$$M'_{C5} = M_{C4} + (M_{C6} - M_{C4}) \cdot \frac{X'_5 - X_4}{X_6 - X_4}$$

$$M'_{C5} = 1.60 + (1.35 - 1.60) \cdot \frac{128 - 103}{160 - 103}$$

$$M'_{C5} = 1.49$$

$M'_{C5}=1.49$

By well known incrementation techniques, the substitute measurement values $M'(F(Z_i))$ are determined for each ink zone of each color.

Figure 5A:
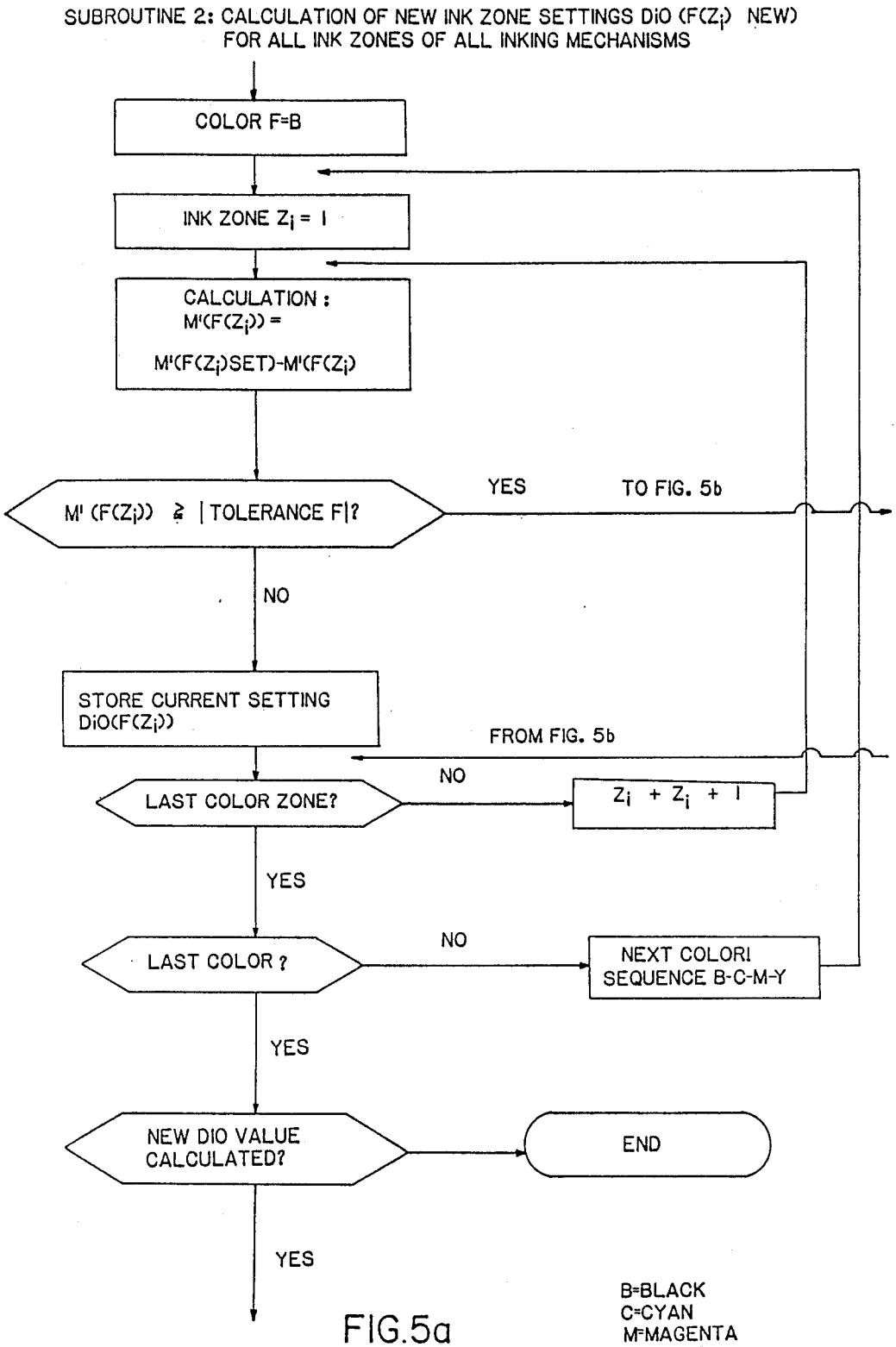
Figure 5B:
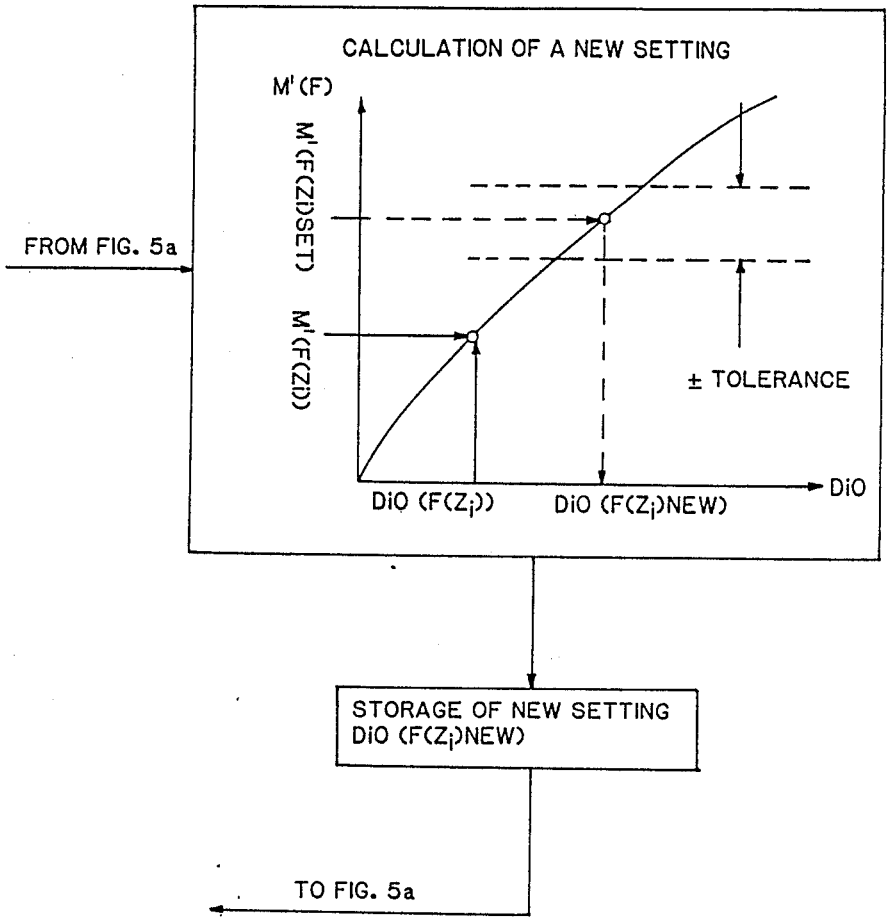

As noted on FIG. 3b, once the substitute measured values have been determined and stored for each ink zone of each color, a subroutine 2, shown most particularly in FIGS. 5a and 5b, calculates new (or updated) ink metering duct settings $Dio(F(Z_i)new)$ for each ink metering duct corresponding to each ink zone.

The operation of ink metering ducts which control the amount of ink applied in the various ink zones are shown, for example, in the above incorporated by reference U.S. Pat. No. 4,660,470 and "Heidelberg CPC" publication.

Referring now to FIG. 5 (i.e., FIGS. 5a and 5b viewed in conjunction with one another), it will be seen that a subroutine designated as subroutine 2 calculates new ink metering duct settings $Dio(F(Z_i)new)$ for each ink color (black, cyan, magenta, yellow, etc.) and for each ink zone $Z_i$ thereof. The differences between the desired substitute measured color related values $M'(F(Z_i)set)$ and the actual substitute measured color related values $M'(F(Z_i))$ output from subroutine 1 are determined. These differences are then compared to determine whether they exceed a tolerance factor F. If the tolerance factor F is not exceeded, then the current ink metering duct setting $Dio(F(Z_i))$ is again stored in memory. If, on the other hand, the tolerance F is exceeded, then subroutine 2 reverts to an empirical curve stored in the memory of measurement apparatus 14. In a preferred embodiment, this empirical curve is stored in memory as a look up table. Through the use of iteration procedures well known in the art, a new ink metering duct setting Dio(F($Z_i$)new) is calculated so as to produce successive approximations to the ink metering duct setting which will yield the desired substitute measured color related value M'(F($Z_i$)set). Iteration techniques are taught in U.S. Pat. Nos. 4,696,015, entitled "Echo Correction Especially for Television Broadcast Systems", 3,903,399, entitled "System and Method for Converging Iterations and Hybrid Loadflow Computer Arrangement", and 3,886,332, entitled "Application of Basecase Results to Initiate Iterations and Test for Convergence in a Hybrid Computer Arrangement Used to Generate Rapid Electric Power System Loadflow Solutions", all of which are hereby expressly incorporated by reference as if the contents thereof were fully set forth in their entirety herein.

This new ink metering duct setting Dio(F($Z_i$)new) is then stored in memory. By incrementation, the appropriate updated ink metering duct settings are determined for each ink zone of each ink color, and the updated ink metering duct settings are stored in the memory of the control stand 12 and transmitted to the printing press 10 itself. This process is continued, at appropriate intervals, for succeeding sheets printed on the printing press 10 until adequate agreement exists between the desired color related values of the control strip and the measured values thereof.

Referring back now to FIG. 3, it will be seen that the updated ink metering duct settings Dio(F($Z_i$)new) for each ink zone of each ink color are transmitted back to the printing press control stand 12 and thence to the printing press 10 itself. The process of printing, analyzing a print control strip on a printed sheet and adjusting the ink metering duct settings based on such analysis as described above may be repeated until a desired degree of quality has been achieved. In practice, it has been found that the process according to the present invention converges quite rapidly to production run quality. Thereafter, measurement apparatus 14 may be conveniently used, as necessary, to monitor the quality of the production run.

While the algorithm set forth in FIGS. 3–5 has been described with respect to a process which includes presetting, convergence to production quality and production run monitoring, it is clear that the principles thereof may be adapted for use in any one particular aspect of this process, and such adaptation and use is contemplated as being within the scope of the present invention.

Referring now to FIG. 6, another print control strip 1 has individual color fields 2 of different colors and structure arranged in a row. For purposes of explanation, boundary lines 3 have been drawn, which divide the ink zones of the ink duct of a printing press. The individual ink zones are numbered sequentially by numbers 4. In the vicinity of the boundary lines 3 between two ink zones, the print control strip has alternating single color solid tone fields 5 for each ink color and single color halftone fields 6 for each ink color. The single color halftone fields 6 are hereby advantageously configured as dot halftone fields. Both the solid tone fields 5 and the halftone fields 6 are arranged alternately over the length of the print control strip 1. In addition, corresponding to every second zone between the halftone fields 6, there are multicolor dot halftone fields 7 in the vicinity of the boundary lines 3. In the embodiment of FIG. 6, the total covered surface in each multicolor dot halftone field 7 is almost the same as the covered surface in the single color dot halftone fields 6, and preferably in the three-quarter tone range; it is unimportant whether a dot halftone field is executed with 75 percent halftone tone value of one color or, like the dot halftone field 7 shown in the embodiment of FIG. 6, as a three color halftone field, with 40 percent cyan, 32 percent magenta and 32 percent yellow.

The necessary surface coverage of the individual ink separations and all the partial surfaces which result in the compression can be determined according to the "Neugebauer Equation". 10, If, for example, we consider a 15 percent to 40 percent halftone tone value, then we get the following halftone fields with the same surface coverage in the printing.

Single color dot halftone fields: 75% halftone tone value

Two color dot halftone fields: $2\times48\%$ halftone tone value

Three color dot halftone fields: $3\times35\%$ halftone tone value

The proportion of white paper in all cases is approximately 13 percent.

Multicolor halftone fields configured in this manner also have the advantage that they do not overvalue color shifts by changes in the color absorption behavior.

Since three color halftone fields are also used advantageously for visual evaluation, the surface coverage of the individual colors should preferably be tuned to grey, which reacts in a manner particularly sensitive to the color cast. For example, under normal conditions, and also with approximately 13 percent white paper, a grey in the print would result for the following halftone tone values in the film:

Cyan: 40 percent

Magenta: 32 percent

Yellow: 32 percent

FIG. 7 (i.e., FIGS. *7a*, *7b*, *7c* and *7d* viewed in conjunction with one another) depicts a flow chart of an algorithm used to monitor and adjust a printing process employing the printing control strip shown in FIG. 6. In FIG. 7, for purposes of illustration, the various algorithmic steps have been shown as being divided up among a printing press 10, a control stand 12 for controlling the operation of printing press 10 and a measurement apparatus 14 (for example, a scanning densitometer) having an associated input device (such as a keyboard), programmable memory and software. However, whereas the algorithm depicted in FIG. 7 constitutes the best mode implementation known to the inventors at the present time, other algorithms for implementing the present invention may nonetheless be equivalent to that specifically set forth and will, therefore, fall within the spirit and scope of the present invention as defined in the appended claims.

FIG. 7 assumes that there is to be some "presetting" of the printing press variables. For example, and referring now most particularly to FIG. *7a*, the ink metering duct settings Dio($Z_i$) for each ink zone $Z_i$ and each color F may be entered. Additionally, the color strip width b(F) for each color F, as well as other pertinent variables relating to the printing stands could be entered.

As discussed above, such preset values may be available from earlier printings of the same material, or may be derived from the output of a printing plate image reader such as the one described in the aforementioned publications which have been incorporated by reference. These preset values are stored in the memory of the control stand 12 and are transmitted to the printing press 10 and the memory of the measurement apparatus 14 at an appropriate time.

Figure 7A:
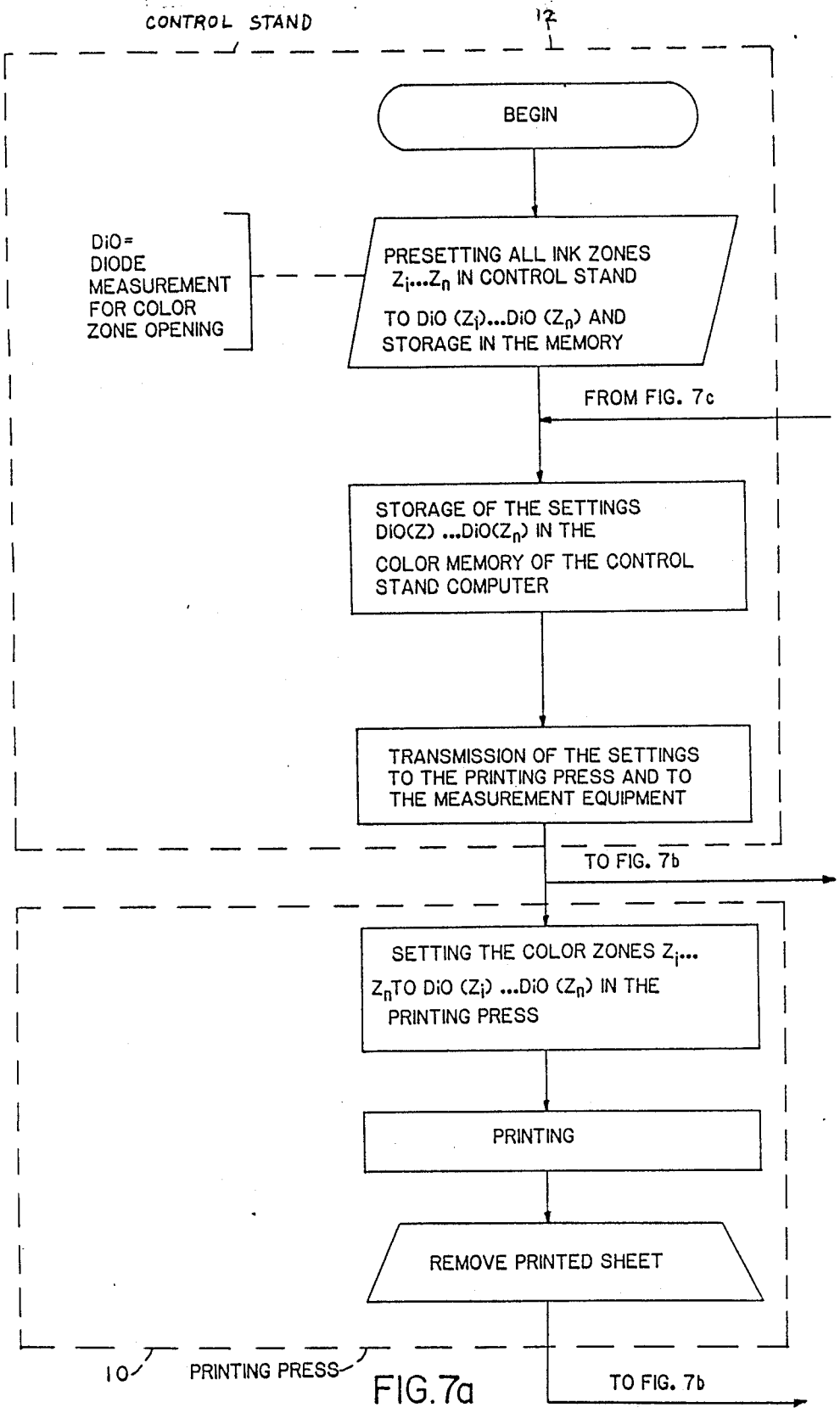
Figure 7B:
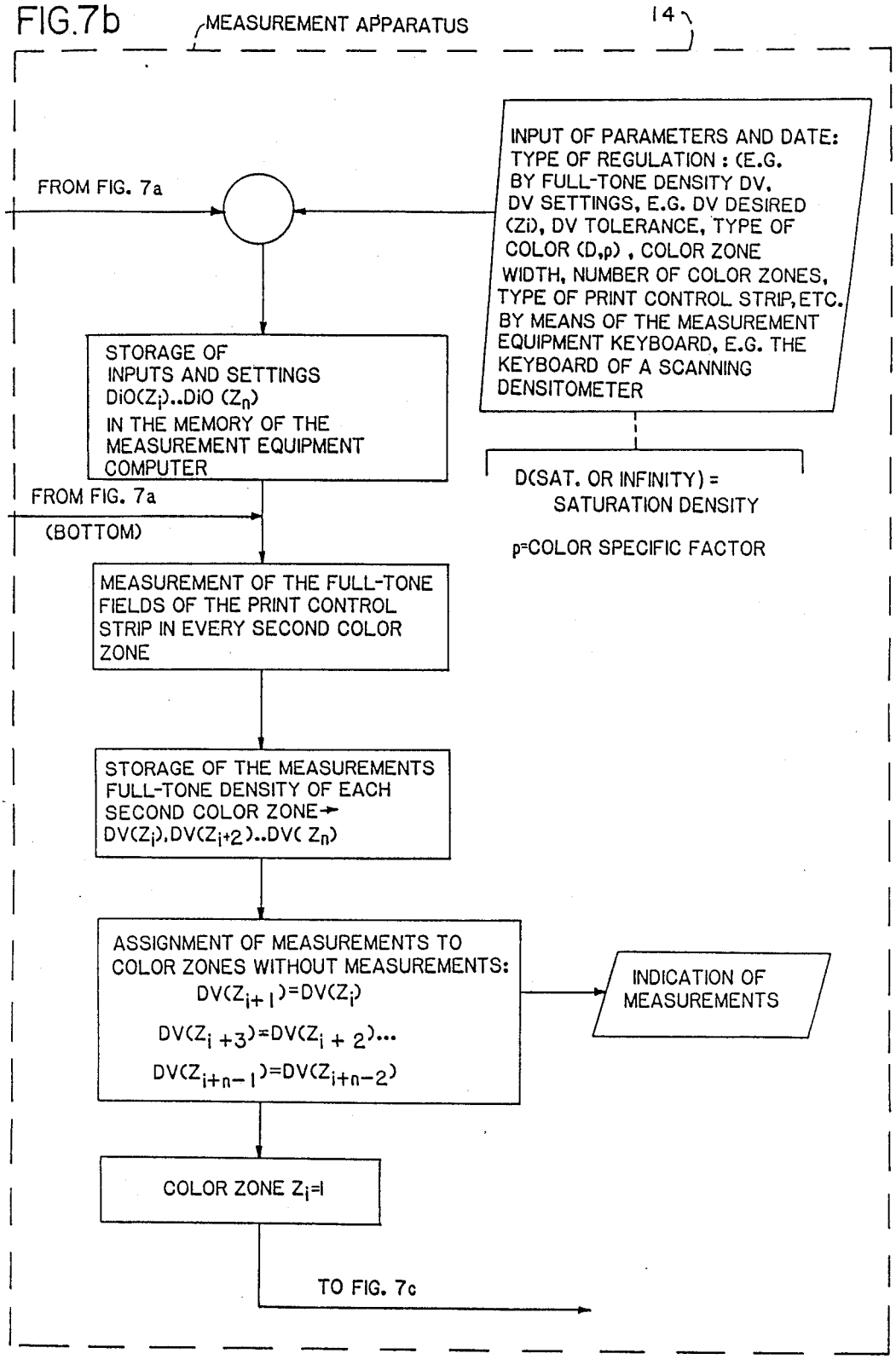

As shown in FIG. 7*b*, various relevant parameters are also entered into measurement apparatus 14 via the associated input device and are stored in the programmable memory provided therewith. For example, the following parameters may be entered:

- the type of control to be employed, for example, solid tone density DV or halftone density DR;
- the desired target solid tone density levels [e.g., DV desired ($Z_i$)] for each ink zone $Z_i$ of each color F;
- parameters relating to each color F, for example, the saturation density [e.g., D(sat. or infinity)] and the color specific factor p;
- specific variables relating to the particular printing press 10 being used, for example, the number of ink zones and the widths thereof; and
- specific variables relating to the type of print control strip being used.

In the algorithm illustrated in FIG. 7, it is assumed that the printing process is being adjusted and/or monitored through the use of solid tone density (or DV) control. However, it will be understood by those of ordinary skill in the art that an analogous procedure can be employed where adjustment is being carried out using halftone density (or DR) or a combination of solid tone density DV and halftone density DR, or even further, where the printing procedure is being controlled according to a colorimetric analysis of the multicolor halftone fields 7 of the print control strip shown in FIG. 6.

A number of preproduction sheets are now printed sufficient to allow some stabilization of the printing process, whereupon a printed sheet is removed from the printing press 10 and transferred to the measurement apparatus 14. There, the print control strip (shown schematically in FIG. 6) which is produced on the printed sheet is analyzed by the measurement apparatus 14 which reads and stores in its associated memory a solid tone density DV measurement for every other or second ink zone, e.g., $DV(Z_i)$, $DV(Z_{i+2})$ . . . $DV(Z_n)$. As noted above, such "two zone measurement" process takes advantage of the fact that there are not any abrupt transitions in the ink distribution and therefore reduces by approximately half, the number of required measurements.

The ink zones in which measurements were not recorded are now assigned the solid tone density value of an adjacent ink zone in which a measurement was recorded. That is, for example: $DV(Z_{i+1})=DV(Z_i)$, $DV(Z_{i+3})=DV(Z_{i+2})$ . . . and $DV(Z_{i+n-1})=DV(Z_{i+n-2})$.

Figure 7C:
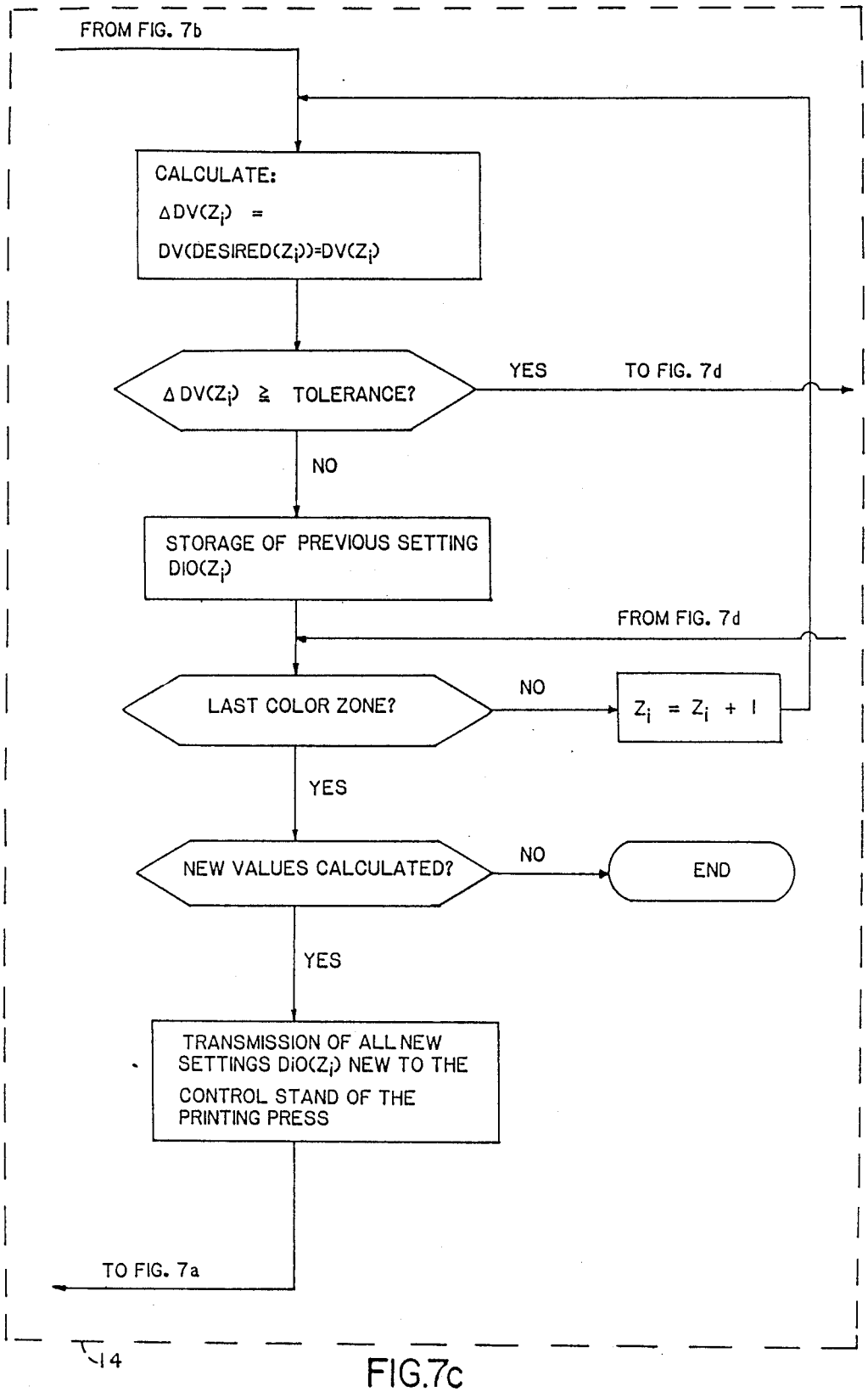
Figure 7D:
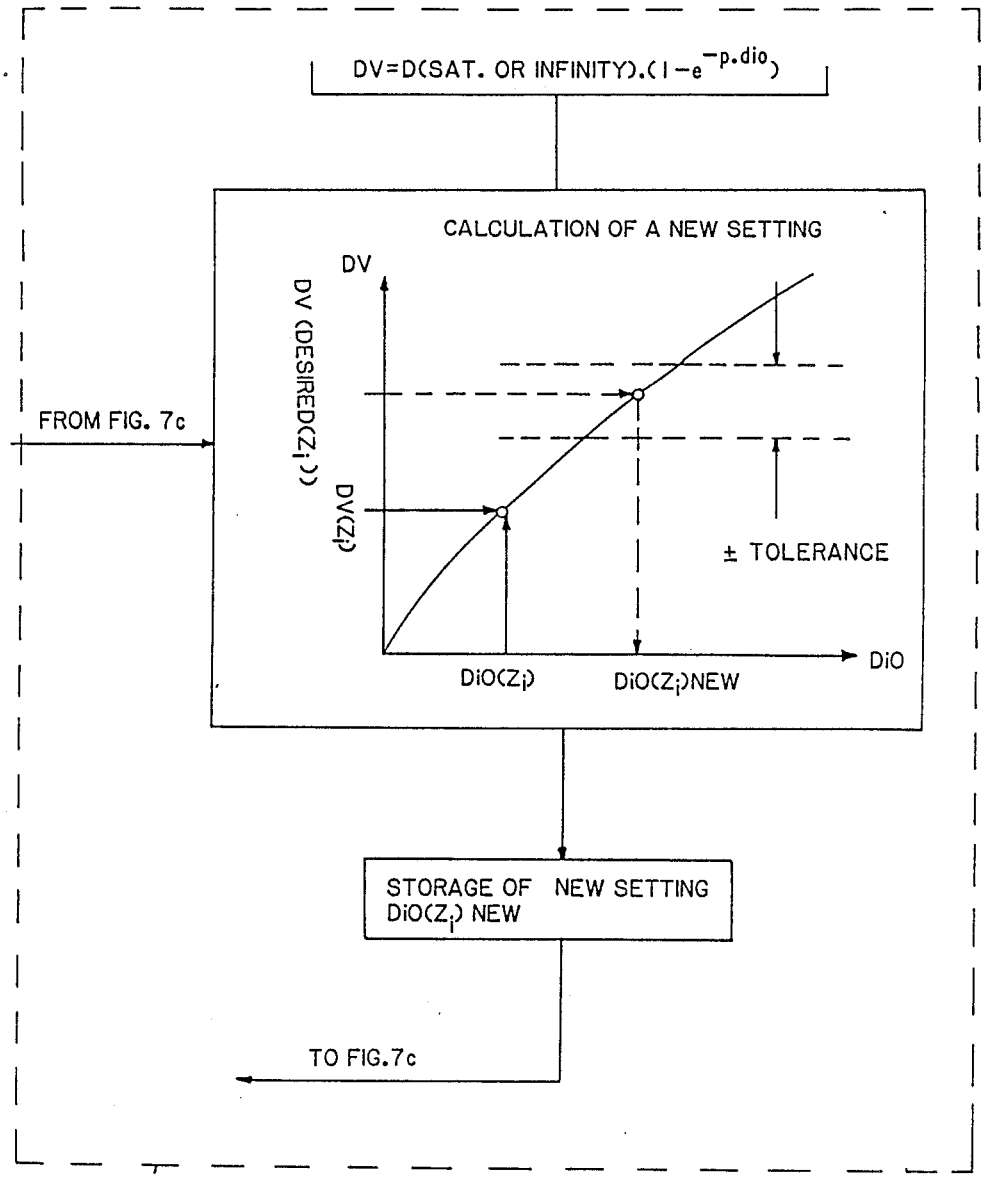

The updated ink metering duct settings $Dio(Z_i)$new are now calculated as shown in FIGS. 7*c* and 7*d*. Through the use of incrementation techniques, the updated ink metering duct settings are calculated for each ink zone $Z_i$ of each color F. The difference between the desired solid tone density and the actual measured solid tone density, i.e., $DVdesired(Z_i)-DV(Z_i)$, is determined for each ink zone. This calculated deviation is then compared to a "Tolerance" factor. If the "Tolerance" factor is not exceeded, then the previous ink metering duct setting $Dio(Z_i)$ is stored as the updated ink metering duct setting $Dio(Z_i)$new. If however, the tolerance factor is exceeded, then a new ink metering duct setting is calculated through use of a curve stored in the memory of measurement apparatus 14. In a preferred embodiment, this curve is stored in memory as a look-up table, and is of the general form of DV=D(sat. or infinity).$(1-e^{-p.Dio})$. Through the use of iteration procedures well known in the art, a new ink metering duct setting $Dio(Z_i)$new is calculated so as to produce successive approximations to the ink metering duct setting which will yield the desired solid tone density measurement $DVdesired(Z_i)$ The updated ink metering duct settings $Dio(Z_i)$new for each ink zone $Z_i$ of each ink color F are transmitted back to the printing press control stand 12 and thence to the printing press 10 itself. The process of printing, analyzing a print control strip on a printed sheet and adjusting the ink metering duct setting based on such analysis as described above, may be repeated until a desired degree of quality has been achieved. In practice, it has been found that the process according to the present invention converges quite rapidly to production run quality. Thereafter, measurement apparatus 14 may be conveniently used, as necessary, to monitor the quality of the production run.

While the algorithm set forth in FIG. 7 has been described with respect to a process which includes presetting, convergence to production quality and production run monitoring, it is clear that the principles thereof may be adapted for use in any one particular aspect of this process, and such adaptation and use is contemplated as being within the scope of the present invention.

The invention as described hereinabove in the context of the preferred embodiments is not to be taken as limited to all of the provided details thereof, since modifications and variations thereof may be made without departing from the spirit and scope of the invention.

What is claimed is:

1. Print control strip image production means for producing an image on printing plates, the image on the printing plate being for indicating the printing condition of a printing press, the printing press being operable to print at least both a first ink of a first color and a second ink of a second color, the second color being substantially different from the first color, the printing press having a first printing plate extending across the printing press for receiving and for transferring to a print receiving material the first ink of the first color, the printing press also having a second printing plate extending across the printing press for receiving and for transferring to the print receiving material the second ink of the second color, the printing press additionally having a first plurality of ink metering devices for metering the application of the first ink into the printing press, the first plurality of ink metering devices extending sequentially across the printing press, the printing press also having a second plurality of ink metering devices for metering the application of the second ink into the printing press, the second plurality of ink metering devices also extending sequentially across the printing press, the positioning of the first and second pluralities of ink metering devices defining ink zones of the printing press extending sequentially across the printing press, the ink zones of the printing press being separated from one another by ink zone boundaries, said print control strip image production means comprising:

- an image bearing medium having having thereon a multiplicity of measurement field images;
- a first set of said multiplicity of measurement field images comprising:

a first single color solid tone image of a solid tone field corresponding to the first ink; and a second single color solid tone image of a solid tone field corresponding to the second ink;

said first single color solid tone image and said second single color solid tone image being positioned on said image bearing medium adjacent and touching one another;

each of said first set of measurement field images being located transversely on said image bearing medium at a position for producing a solid tone measurement field image on the first and second printing plates, which first set spans across one of the ink zone boundaries; and a second set of said multiplicity of measurement field images comprising:

a first single color halftone image of a halftone field corresponding to the first ink; and a second single color halftone image of a halftone field corresponding to the second ink;

said first single color halftone image and said second single color halftone image being positioned on said image bearing medium adjacent and touching one another;

each of said second set of measurement field images being located transversely on said image bearing medium at a position for producing a halftone measurement field image on the first and second printing plates, which second set spans across one of the ink zone boundaries; and said first and second sets of measurement field images being alternately disposed across said image bearing medium.

2. The print control strip image production means according to claim 1, wherein said second set of measurement field images additionally comprises a multicolor halftone image comprising a first halftone field image corresponding to the first ink and a second halftone field image corresponding to the second ink.

3. The print control strip image production means according to claim 2, wherein the printing press is provided with at least third and fourth pluralities of ink metering devices for metering the application of third and fourth inks, respectively, into the printing press, wherein each of said first set of measurement field images additionally comprises at least third and fourth single color solid tone images corresponding to said third and fourth inks, respectively, and wherein each of said second set of measurement field images additionally comprises at least third and fourth single color halftone images corresponding to said third and fourth inks, respectively.

4. The print control strip image production means according to claim 1, wherein each of said single color halftone images comprises a single color dot halftone image.

5. The print control strip image production means according to claim 2, wherein each of said single color halftone images comprises a single color dot halftone image.

6. The print control strip image production means according to claim 3, wherein each of said single color halftone images comprises a single color dot halftone image.

7. The print control strip image production means according to claim 2, wherein said multicolor halftone image comprises a multicolored dot halftone image.

8. The print control strip image production means according to claim 3, wherein said multicolor halftone image comprises a multicolor dot halftone image.

9. The print control strip image production means according to claim 4, wherein said multicolor halftone image comprises a multicolor dot halftone image.

10. The print control strip image production means according to claim 5, wherein said multicolor halftone image comprises a multicolor dot halftone image.

11. The print control strip image production means according to claim 6, wherein said multicolor halftone image comprises a multicolor dot halftone image.

12. The print control strip image production means according to claim 4, wherein each of said single color dot halftone images has an area of surface coverage of about 75 percent.

13. The print control strip image production means according to claim 5, wherein each of said single color dot halftone images has an area of surface coverage of about 75 percent.

14. The print control strip image production means according to claim 13, wherein said multicolor dot halftone image has an area of surface coverage of about 75 percent.

15. A process for controlling the application of at least a first ink of a first color and at least a second ink of a second color into a printing press, the second color being substantially different from the first color, the printing press having a first printing plate extending across the printing press for receiving and transferring the first ink of the first color to a print receiving material, the printing press also having a second printing plate extending across the printing press for receiving and transferring to the ink receiving material the ink of the second color, the printing press having a first plurality of ink metering devices for metering the application of the first ink into the printing press, the first plurality of ink metering devices extending sequentially across the printing press, the printing press also having a second plurality of ink metering devices for metering the application of the second ink into the printing press, the second plurality of ink metering devices also extending sequentially across the printing press, the positioning of the first and second pluralities of ink metering devices defining ink zones of the printing press extending sequentially across the printing press, the ink zones of the printing press being separated from one another by ink zone boundaries, said process comprising the steps of:

(a) producing, on the first and second printing plates, an image of a print control strip, the print control strip comprising:

an image bearing medium having having thereon a multiplicity of measurement field images;

a first set of said multiplicity of measurement field images comprising:

a first single color solid tone image of a solid tone field corresponding to the first ink; and a second single color solid tone image of a solid tone field corresponding to the second ink;

said first single color solid tone image and said second single color solid tone image being positioned on said image bearing medium adjacent and touching one another;

each of said first set of measurement field images being located transversely on said image bearing medium at a position for producing a solid tone measurement field image on the first and second printing plates; and a second set of said multiplicity of measurement field images comprising:

a first single color halftone image of a halftone field corresponding to the first ink; and a second single color halftone image of a halftone field corresponding to the second ink;

said first single color halftone image and said second single color halftone image being positioned on said image bearing medium adjacent and touching one another;

each of said second set of measurement field images being located transversely on said image bearing medium at a position for producing a halftone measurement field image on the first and second printing plates; and said first and second sets of measurement field images being alternately disposed across said image bearing medium;

(b) applying said first ink of said first color to said first printing plate through said first plurality of ink metering devices;

(c) applying said second ink of said second color to said second printing plate through said second plurality of ink metering devices;

(d) transferring the first ink of the first color from the first printing plate and the second ink of the second color from the second printing plate to the print receiving material to form an image of the print control strip thereon;

(e) analyzing, selectively only one of the following:

(1) the first set of measurement field images comprising first and second solid tone images of the first and second inks, respectively; and (2) the second set of measurement field images comprising first and second halftone images of the first and second inks, respectively; and (f) adjusting said first and second pluralities of ink metering devices based upon the analysis carried out in said step (e).

* * * * *

UNITED STATES PATENT AND TRADEMARK OFFICE

CERTIFICATE OF CORRECTION

PATENT NO. : 4,947,746

DATED : August 14, 1990

INVENTOR(S) : Willi JESCHKE and Gerhard LÖFFLER

It is certified that error appears in the above-identified patent and that said Letters Patent is hereby corrected as shown below:

In column 2, line 62, after 'image', delete ":" and insert --;--.

In column 3, line 17, after "dium", delete ":" and insert --;--.

In column 3, line 23, after 'receptor', delete ":" and insert --;--.

In column 3, line 31, after 'process', delete ":" and insert --;--.

In column 3, line 35, after 'zones', delete ":" and insert --;--.

In column 7, line 34, after 'value', delete the first part of the equation which reads "$[X'(Z_i) - X-$", and insert -- $[X'(Z_i)$ X-- in its place.

In column 8, line 20, after "0", delete "$0_{\rightarrow no}$", and insert --0→no-- in its place.

In column 8, line 36, delete the equation "$M'_{C5} = 1.49$".

UNITED STATES PATENT AND TRADEMARK OFFICE

CERTIFICATE OF CORRECTION

PATENT NO. : 4,947,746

DATED : August 14, 1990

INVENTOR(S) : Willi JESCHKE and Gerhard LÖFFLER

It is certified that error appears in the above-identified patent and that said Letters Patent is hereby corrected as shown below:

In column 10, line 11, after the period, delete "10,".

In column 11, line 52, after 'and', delete "$DV(Z_{i+n-1})$=DV-" and insert --$DV(Z_{i+n-1})$=DV-- in its place.

Signed and Sealed this

Twenty-first Day of July, 1992

*Attest:*

DOUGLAS B. COMER

*Attesting Officer*

*Acting Commissioner of Patents and Trademarks*